US005421386A

United States Patent [19]

Lundström

[11] Patent Number: 5,421,386

[45] Date of Patent: Jun. 6, 1995

[54] BREAKDOWN OF LOGS

[75] Inventor: Lars-Gunnar Lundström, Överhörnäs, Sweden

[73] Assignee: Ari AB, Ornskoldsvik, Sweden

[21] Appl. No.: 162,205

[22] PCT Filed: Jun. 17, 1992

[86] PCT No.: PCT/SE92/00438

§ 371 Date: Dec. 8, 1993

§ 102(e) Date: Dec. 8, 1993

[87] PCT Pub. No.: WO92/22402

PCT Pub. Date: Dec. 23, 1992

[30] Foreign Application Priority Data

Jun. 17, 1991 [SE] Sweden ..... 9101864

[51] Int. Cl.[6] ..... B27B 1/00; B27M 1/08

[52] U.S. Cl. ..... 144/357; 144/3 R; 144/39; 144/370; 144/378; 144/367

[58] Field of Search ..... 144/3 R, 39, 41, 369, 144/375, 377, 378, 370, 356, 357, 367

[56] References Cited

U.S. PATENT DOCUMENTS

| | | | |
|---|---|---|---|
| 3,934,630 | 1/1976 | Cockle | 144/39 |
| 4,335,767 | 6/1982 | Reuter | 144/378 |
| 4,548,247 | 10/1985 | Eklund | 144/39 |
| 4,572,256 | 2/1986 | Rautio | 144/39 |
| 4,711,279 | 12/1987 | Reuter | 144/41 |
| 4,848,427 | 7/1989 | Reuter | 144/39 |
| 4,881,584 | 11/1989 | Wislocker et al. | 144/39 |
| 5,143,127 | 9/1992 | Rautio | 144/39 |
| 5,320,153 | 6/1994 | Knerr | 144/378 |

FOREIGN PATENT DOCUMENTS

| | | |
|---|---|---|
| 3114843 | 10/1982 | Germany . |
| 334953 | 6/1984 | Germany . |
| 3514892 | 8/1986 | Germany . |
| 438110 | 4/1985 | Sweden . |
| 464466 | 4/1991 | Sweden . |

*Primary Examiner*—W. Donald Bray
*Attorney, Agent, or Firm*—Lee, Mann, Smith, McWilliams, Sweeney & Ohlson

[57] ABSTRACT

In a method of sawing a log where, to avoid edging, inner comers (3) are first cut out prior to sawing off the edged boards, inner corners (3) are cut out along curved lines, each with a planar smooth surface (4) and a chopped rough surface (5) which is curved, whereafter the respective board is sawed out with a curved saw cut which coincides with the respective chopped rough curved surfaces (5).

10 Claims, 4 Drawing Sheets

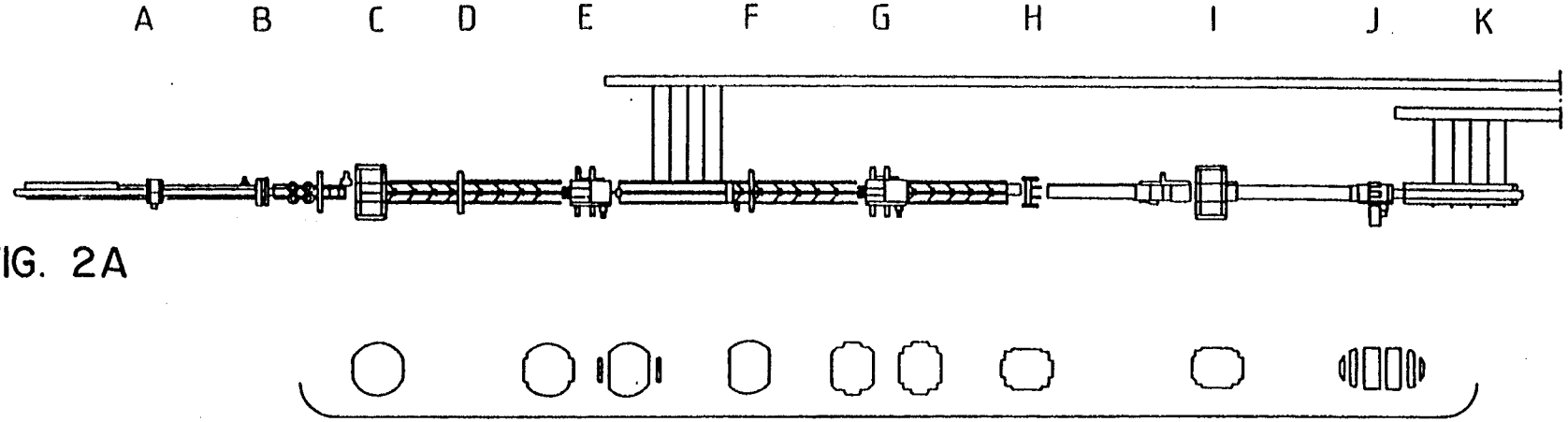
FIG. 2A
FIG. 2B
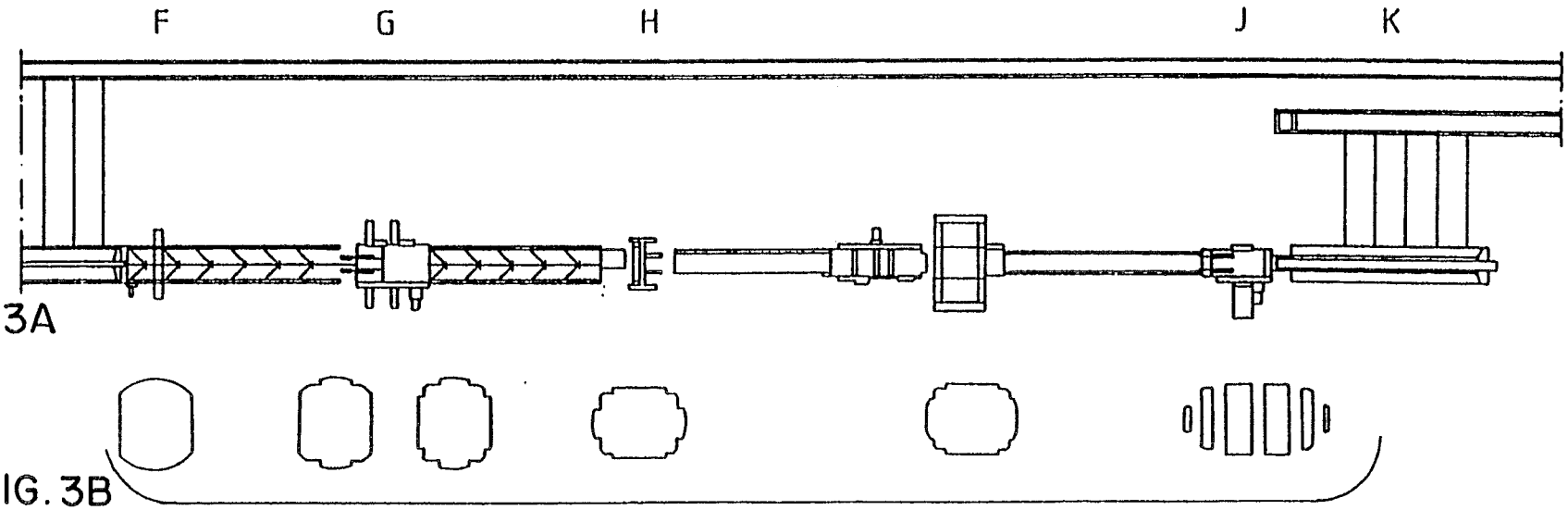
FIG. 3A
FIG. 3B

BREAKDOWN OF LOGS

The present invention relates to a method for dividing logs, particularly curved logs.

The basic problem when sawing logs is that the logs are round and, in a first approximation, are conical, while boards are desired in rectilinear shape. The residual wood when sawing can be used in the pulp industry provided it can be divided into wood chips with long fibres. This has for many years been done with a so-called chipper, thus providing a log with large flat portions, and from the four sides there are then sawn side boards with wanes, which are sawed off in a following edge saw as laths. The remaining block is then sawed in an obvious manner in the desired dimensions.

In order to obviate the need to edge waned side boards, it has been suggested that from the log itself there be removed the wood corresponding to the wane laths, by means of two cuts for each lath, forming an inner corner, this being accomplished by milling/chipping, thus providing usable chips. The side boards can then be cut out later without any wane. One of the said cuts thus forms the board edge surface and it must be somewhat smooth, and this puts particular demands on the milling tool, see e.g. DE-A-3 114 843 or SE-A-7906747-6. Other tools are also conceivable for achieving the intended good surface, of a quality corresponding to a sawn surface.

Another problem in sawing is that the logs are seldom straight. In Scandinavia this problem has long been dealt with by sawing along a curved path with the saw cuts essentially parallel to the pith. The resulting boards and planks will be crooked to be sure but they can be dried while held straight in a pile and thereafter remain straight without inner stresses. Straight sawn lumber from a curved log will, despite being laid in piles, tend to be crooked and warped after drying. Such curved sawing is usually done by first orienting the curvature essentially in a vertical plane and planing and sawing off the side boards with vertical plane cuts. The log is then turned 90° and the rest of the sawing is then done along a curved path by arranging steering means slightly in front of the saw itself, and the log is then passed through following its curved shape.

It is a general purpose of the invention to increase the economic yield when sawing logs, both in the form of boards of highest possible quality and good chips by optimizing the sawing both in regard to the truncated conical ideal shape of the log and to the curvature which is almost always present.

This is achieved according to the invention by virtue of a method of the type described by way of introduction which has the characterizing features disclosed in the characterizing clause of claim 1. A suitable device for carrying out the invention is disclosed in claim 6.

The solution suggested according to the invention can in short and schematically, without limitation, be described as follows: The log is placed with its curvature in a vertical plane and is planed in this position from the sides so that two parallel planes are obtained. It is imparted a polygon shape by cutting out "inner corners". First thereafter, the log is turned 90° and the prepared boards are sawed out. The cutting out of the "inner corners" is done while following the curvature of the log, i.e. with a vertically displaceable chipping means, while the subsequent sawing is effected by the curved sawing method which is known per se.

The invention will be described on the basis of an example and with the aid of the figures.

FIG. 2 shows schematically a complete saw-mill line, where the logs enter from the left and are completely sawn.

FIG. 3 shows the latter portion of the line in FIG. 2 on a larger scale.

Figure 1C:
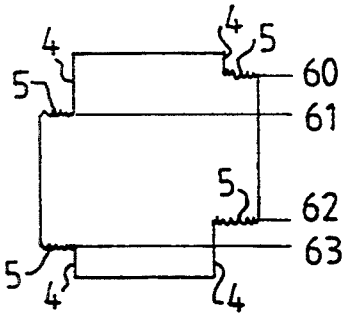
FIG. 1C shows an alternative configuration of cuts.
Figure 1A:
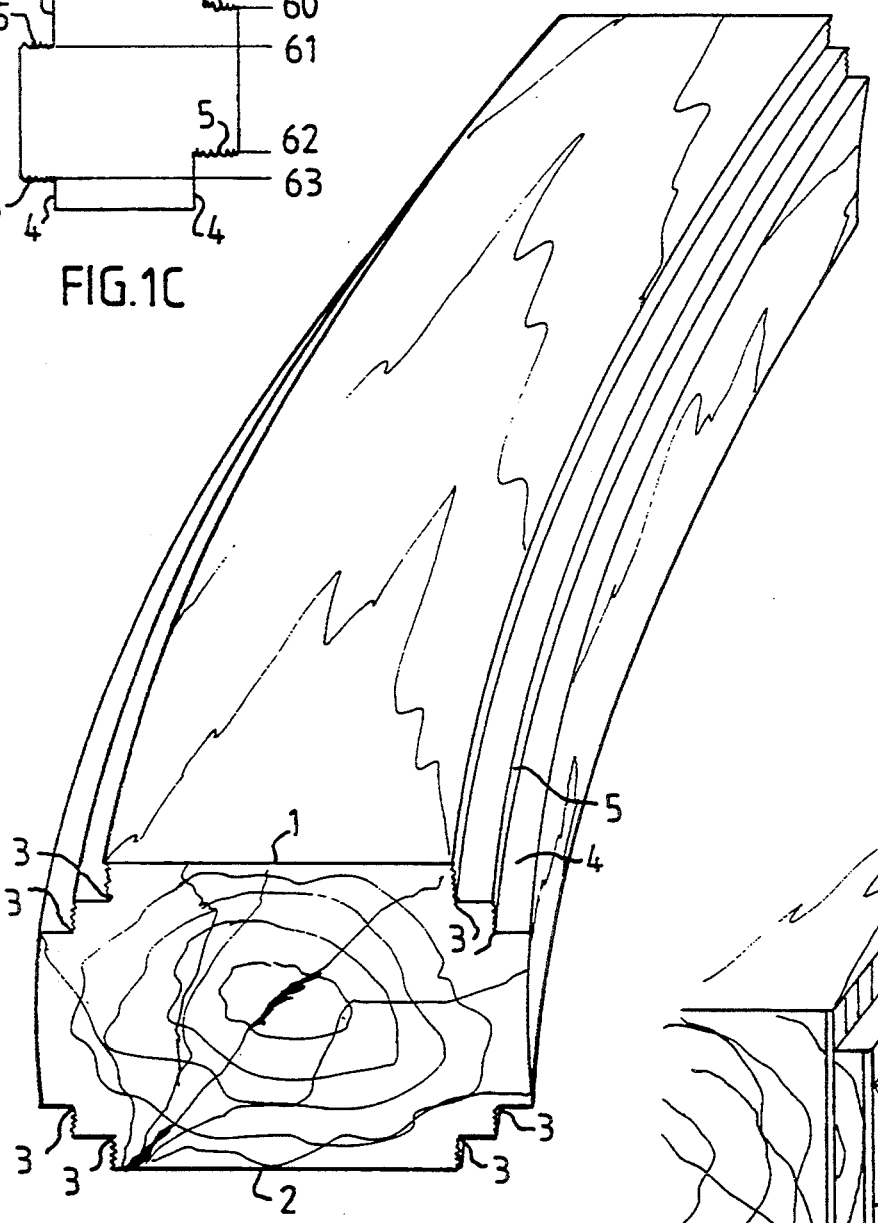
FIG. 1A shows a log prepared for curvature sawing.

FIG. 1A shows a curved log, in an intermediate stage. First the side boards have been removed parallel to the curvature leaving two parallel flat sides 1,2. Corner-shaped notches 3 have been milled out, each having a smooth horizontal surface 4 and a rough surface 5. Both of the surfaces cannot be made smooth because what is desired is chips with long fibres and not shavings, which would have a substantially lower economic value.

Figure 1B:
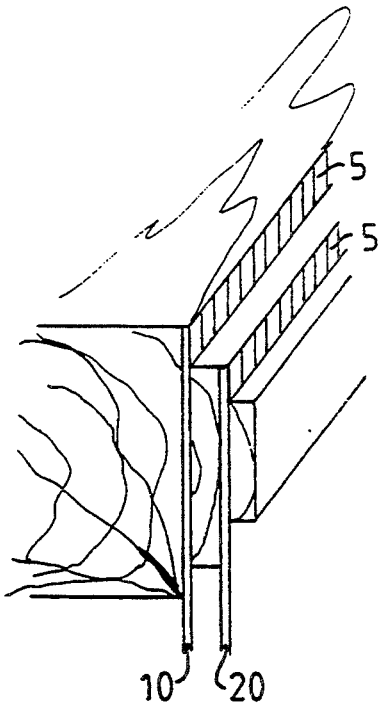
FIG. 1B shows a portion thereof indicating the placement of the cuts for taking out side boards.

FIG. 1B shows how the thusly prepared boards are cut out by means of cuts 10 and 20, placed so that the rough surfaces 5 are eliminated. These saw cuts 10 and 20 are sawn along a curve to provide, as is evident from FIG. 1A, curved but relatively straight fiber boards, which through suitable drying can be made straight, high-quality boards.

FIG. 2 shows schematically a saw-mill line for sawing according to the invention, with stations labelled A–K. Many of these components are conventional and well known and will therefore not be described in more detail here, even if their use according to the invention is unconventional. It is thus an entirely conventional step to measure logs and to calculate with the aid of a computer the most suitable method of sawing, there being different suitable patterns depending on the shape and size of the log. Conveyor means, adjustable, multi-blade saws, turning devices and adjustable reducing saws are now conventional components.

Station A is a measuring frame, through which the log is conveyed and measured in different directions, including its curvature. At station B the log is turned so that its curvature is essentially vertically oriented, upwards or downwards. At station C, the top end of the log is centered and the log is chipped from both sides to parallel planes.

At station D, measurements are taken against the two planes created by the chipper to specify the subsequent sawing of the log.

At station E there is then removed one or more sideboards, preceded by cutting out of corners. The milling tools are special in that they can be raised and lowered in pairs so that the vertical surfaces of the boards sawn can be optimized relative to the orientation of the log; the log is probably inclined due to the root end being thicker and logs are usually somewhat curved. A milling tool is known by DE-A-3 114 843 which is able to cut straight cuts compensating for the greater thickness of the root.

At station F, the two new planar surfaces of the log are measured for further analysis. Then at station G corners are cut out in a manner particular to this invention in that the curvature of the log is followed with rough surfaces; the smooth surfaces being rectilinear. The log is now ready for final sawing after being turned 90° at station H. This final sawing follows the curvature of the log using the cut- out corners as guides. The last of the original round circumference of the log is reduced at station I and the prepared boards are removed at station J, whereafter the sawing of the log is complete. For certain bladeset-ups the reduction can be done so that there are no sideboards left to saw. Rather only a simple rectangular block is left to cut at station J.

In FIG. 2 it can be noted that after the log has been given two parallel planar sides at station D, it is guided by rollers in contact with the sides and mounted in horizontally pivoted resiliently centered-ams.

In accordance with an important aspect of the invention, it is especially important that the milling tools have a sufficient number of degrees of freedom. The subsequent saw cuts are made after the log has been turned 90° and in the usual manner with vertical, curved cuts. Since the width of the boards is to be constant along the length of the log, the distance between the upper and the lower tool on the same side should be kept constant.

These two height adjustments can be coupled kinematically even though this is not the case in the example to be described below, where the movement of the tools is completely independent.

Full independent freedom of movement for all of the tools has the advantage that the inner corners can be cut independently of each other and, as is shown schematically in FIG. 1C, the saw cuts 60–63 can be placed so that each cut coincides with a rough surface on one side so that more boards are removed than the number of pairs of inner corners.

Figure 4:
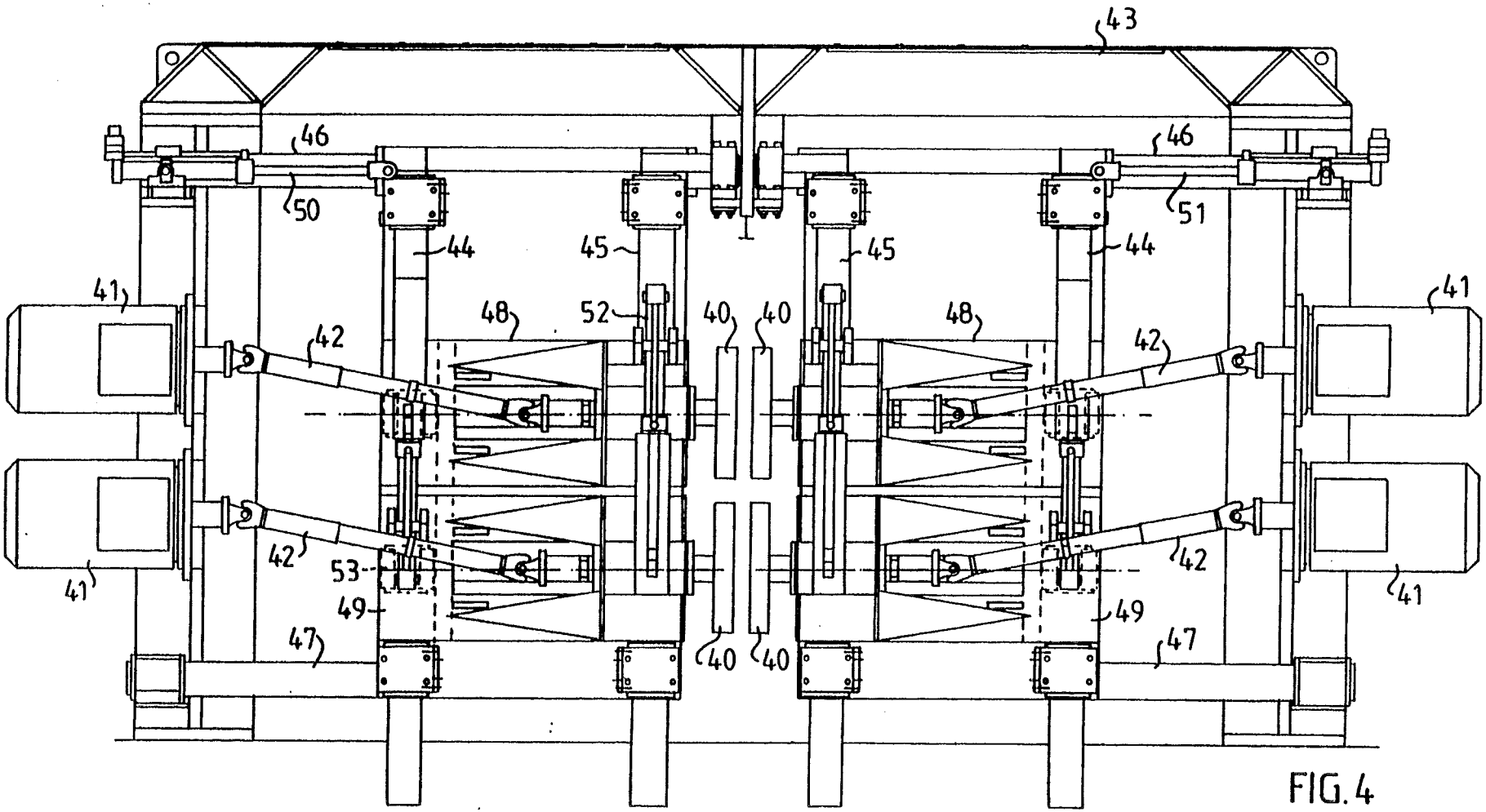
FIG. 4 shows a view from the front of a corner-milling tool.
Figure 6:
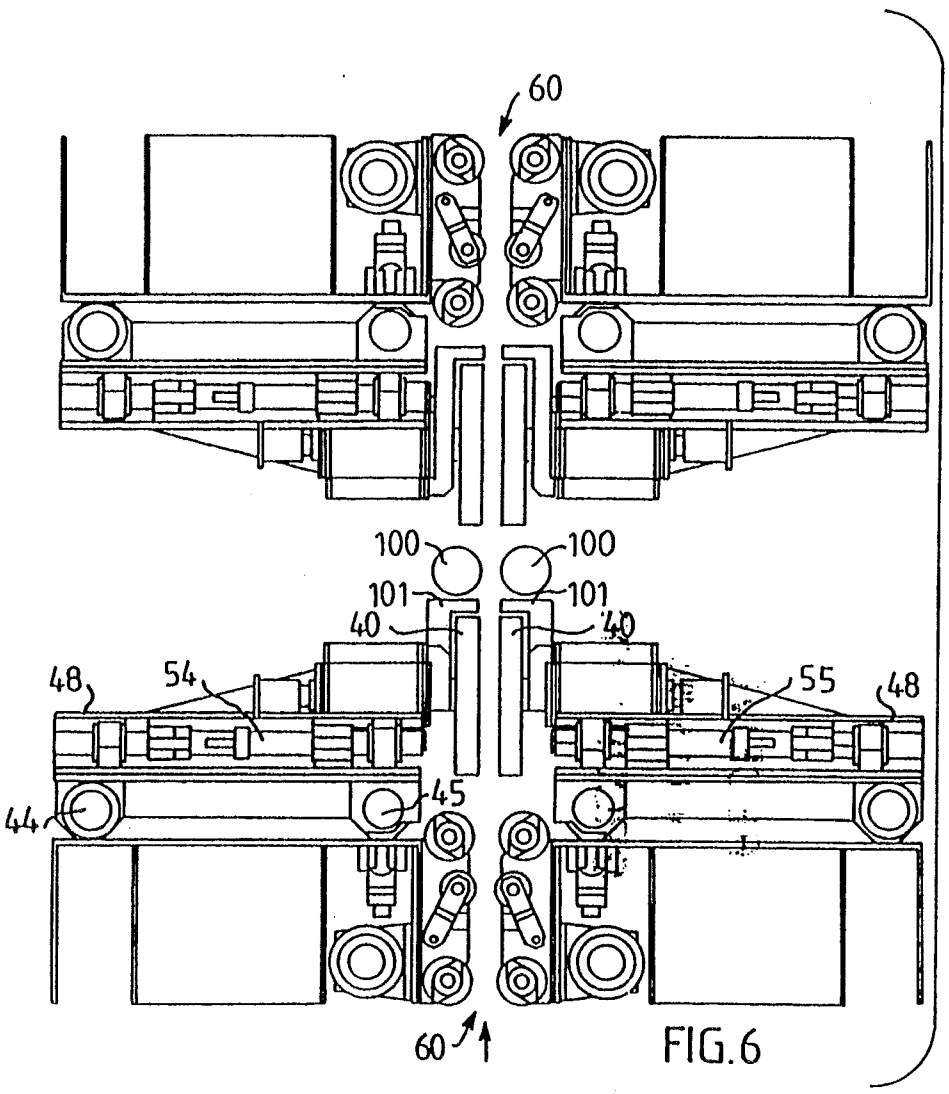
FIG. 6 shows the same corner-milling tool from above.
Figure 5:
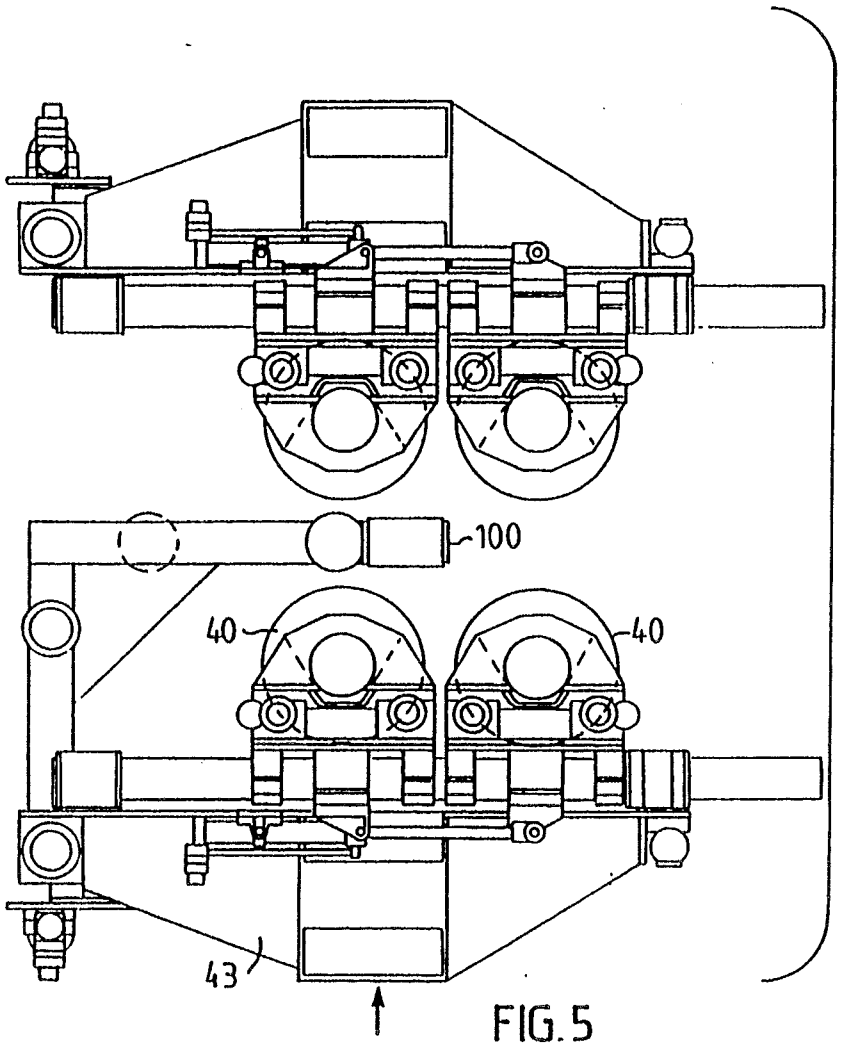
FIG. 5 shows the same corner-milling tool from the side.

FIGS. 4–6 show an example of a corner-milling tool for placement at station J in FIGS. 2 and 3. The machine is doubled so that its first portion cuts out four inner corners while a second portion cuts out four additional inner corners. This doubling is shown in FIGS. 5 and 6. Since the two parts are in principle identical it is sufficient to describe only one of them in detail. The front part has as well two supporting rollers 100 on movable arms steering the log from opposite sides.

In each unit there are four milling cutters 40 which are movable and, as can be seen in FIG. 4, each coupled to an individual motor 41 via drive shafts 42 (not-shown in FIGS. 5 and 6) provided with knuckles and splines. The motors are securely mounted in a rigid machine frame 43.

The various cutters are rotatably disposed in a guide system. Each cutter 40 is vertically displaceable along vertical guides 44,45. These guides 44,45 are in turn displaceable along horizontal guides 46,47.

Each cutter has its shaft rotatably mounted in a carriage 48,49 which can be slid along said pair of vertical guides 44,45. The cutters are movable horizontally relative to the carriages 48,49.

The various movements are effected by means of hydraulic cylinders provided with measuring means, so that they can be servo-controlled. Pairs of guides 44,45 can thus be displaced horizontally by means of the hydraulic cylinders 50,51, respectively, displacing at the same time guide rollers 60 determining the position of the log.

The vertical guides are movable in their longitudinal direction and are fixed to individual carriages 48,49. For example, the upper carriage 48, which also can be seen in FIG. 6, is fixed to the guide 45 but is slidable along the guide 44, the lower carriage 49, on the other hand, is fixed to the guide 44 and is slidable along the guide 45. The guides 44,45 are displaceable by means of hydraulic cylinders 53 and 52, respectively.

When the guide 45 is operated by means of the hydraulic cylinder 52, the upper carriage 48 will be displaced sliding on the guide 44. When the guide 44 is operated by means of the hydraulic cylinder 53, the lower carriage 49 will be displaced sliding on the guide 45.

As regards the horizontal displacement of the milling cutters relative to the log position defined by the hydraulic cylinders 50,51 and the guide rollers 60, there is for each cutter a hydraulic cylinder 54,55 (FIG. 6), so that the tools 40 with their bearings are horizontally displaceable in guides arranged on the carriages 48,49 (schematic dashed lines in FIG. 4 without specific reference numerals).

The milling cutters 40 are thus by virtue of the hydraulic cylinders 52,53 individually adjustable in the vertical direction, while the hydraulic cylinders 54,55 permit individual adjustment of the cutters 40 in the horizontal direction. This permits not only removal of sideboards as in FIG. 1B, i.e. with pairwise symmetry between the cut-out inner corners, but also completely optional cutting as shown e.g. in FIG. 1C, where the only condition is that each milled surface 5 be subsequently made smooth by a subsequent sawing operation.

As has been mentioned above, the four milling cutters 40 shown in FIG. 1 are doubled, as can be seen in FIGS. 5 and 6, with intermediate guide rollers 100. In each device there is also a set of steering and driving rollers 60, as can be seen in FIG. 6. The logs are advanced in the direction of the arrow and pass through the two sets of four milling cutters 40. FIG. 6 also shows chip-deflecting arms 101, which are mounted securely to the cutter holders either above or below leaving a free path for the log.

The machine thus described makes it possible to continuously change the cutter positions during the working of a log, preferably according to the invention in the vertical direction.

A corresponding freedom of movement for the four milling cutters is suitably arranged by vertical rotational shafts at station E in FIG. 2, in which case the movement must be only linear in view of the fact that the sawing out of the first side boards is in the same direction as the vertical movement and the board would otherwise have curved edges.

At station G, however, the movement can follow the curvature of the log which has been previously determined. The most simple method is to effect vertical steering along a circular arc beginning at a level determined relative to the feeder plane entered prior to station C after the log has entered station B. However, nothing prevents one from more carefully following the curvature of the log, i.e. with a more complicated curve than a simple circle curve.

The various movements of the hydraulic cylinders are, as the person skilled in the art realizes, computer controlled depending on the shape of the logs and on setup alternatives dictated thereby, in accordance with computer programs which do not constitute any part of the present invention but lie within the capacity of the average skilled art worker to formulate, and therefore a description thereof must be considered to be superfluous.

We claim:

1. A method of dividing logs, including the steps in which (a) a log is first planed in a planing operation on two opposite sides to form first parallel planes, (b) and then pairs of cut-outs in the form of inner corners are made adjacent to said first parallel planes, said cut-outs having a smooth surface and a rough surface, (c) and thereafter boards are cut from the log by sawing in planes essentially agreeing with a pair of said rough surfaces of an opposite pair of said cut-outs, the improvement comprising (d) before method step (a), rotatably adjusting the log so that said first parallel planes when cut are parallel to a plane coinciding with any curvature of the log so that in method step (b) the pairs of cut-outs are curved essentially following the curvature of the log, (e) then performing method step (a)

(f) then performing method step (b) so that said cut-outs are curved essentially following the curvature of the log with said smooth surfaces lying in spaced, parallel planes and said rough surfaces following the curvature of the log, and (g) then performing method step (c) by curve-sawing.

2. Method according to claim 1, in which method step (a) includes a first reducing operation comprising producing preparatory flat lateral planes coinciding with the curvature of the log, then making corner-shaped cut-outs in conjunction with the preparatory lateral planes, said corner-shaped cut-outs being rectilinear with smooth surfaces perpendicular to the preparatory lateral planes, and then removing first side boards by straight-sawing, leaving on the log said first parallel planes.

3. Method according to claim 1 in which before method step (c) is carried out, in method step (b) at least eight curved inner corner-shaped cut outs are made and during the curve-sawing of method step (c) at least four different saw cuts are made at the same time for removing at least four boards.

4. Method according to claim 1 in which after method step (b) a further reducing operating is carried out to obtain two curved lateral planes on the log which are parallel to the rough curved surfaces of the cut-outs.

5. Method according to claim 1, in which in step (a) the lóg is first advanced with its essential curvature in a vertical plane, said first parallel plane being cut out vertically, and in method step (b) the corner-shaped cut-outs are made with rotating cutters, the rotational axes of which are horizontal under the control of a process control computer, and are disposed to cut smooth vertical surfaces and rough horizontal surfaces, and in method step (c) said curved sawing is carried out after a 90° rotation of the log about is longitudinal axis.

6. Device for chip cutting-out of inner corner-shaped cut-outs in a log, including a series of rotating, motor-driven chopping knife heads with smooth working end surfaces being displaceably mounted in a machine frame arranged transversely to a log-feeding line, said chopping knife heads being arranged in pairs in laterally displaceable vertical planes and within said vertical planes being individually displaceable vertically, and further including first hydraulic cylinders arranged for lateral position displacement, second hydraulic cylinders arranged for vertical displacement, the first and second hydraulic cylinders having linear sensors for providing individual position signals.

7. Device according to claim 6, including a machine frame having horizontal guides to which vertical guides are displaceably mounted by means of third hydraulic cylinders, said vertical guides being coupled to log guide rollers and having mounted thereon carriages, each carriage being fixed to a first of said vertical guides and being slidably mounted to a second of said vertical guides, each carriage being operable by vertical displacement by means of one of said second hydraulic cylinders of the first vertical guide to which the carriage is fixed while sliding on the second vertical guide, said chopping knife heads being mounted on shafts which are rotatably mounted in bearing holders mounted in the individual carriages and being displaceable by means of said first hydraulic cylinders.

8. Device according to claim 7, in which for each chopping knife head there is a separate electric motor fixed to the machine frame, each motor having a motor shaft coupled to the shaft of the respective chopping knife head via a telescoping shaft having driving knuckles.

9. Device according to claim 6, comprising two sequentially arranged devices each having four chopping knife heads with intermediate vertical steering rollers, the shafts of said chopping knife heads being horizontal.

10. Device according to claim 6, in which the chopping knife heads have vertical shafts, and having laterally adjustable saw blades mounted immediately thereafter for vertical sawing off first side boards.

* * * * *